US010204555B2

(12) United States Patent
Tan et al.

(10) Patent No.: US 10,204,555 B2
(45) Date of Patent: Feb. 12, 2019

(54) PIXEL CIRCUIT AND DRIVING METHOD THEREOF, AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Wen Tan, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 124 days.

(21) Appl. No.: 14/652,558

(22) PCT Filed: Oct. 11, 2014

(86) PCT No.: PCT/CN2014/088393
§ 371 (c)(1),
(2) Date: Jun. 16, 2015

(87) PCT Pub. No.: WO2016/000346
PCT Pub. Date: Jan. 7, 2016

(65) Prior Publication Data

US 2016/0284274 A1 Sep. 29, 2016

(30) Foreign Application Priority Data

Jul. 3, 2014 (CN) ..... 2014 1 0317208

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3291* (2013.01); *G09G 3/3266* (2013.01);
(Continued)

(58) Field of Classification Search
CPC .. G09G 3/3258; G09G 3/3291; G09G 3/3266; G09G 2310/0262;
(Continued)

(56) References Cited

U.S. PATENT DOCUMENTS 8,319,307 B1 * 11/2012 Williams ..... H01L 27/14636 250/208.1
2006/0087247 A1 * 4/2006 Malmberg ..... G09G 3/006 315/169.2
(Continued)

FOREIGN PATENT DOCUMENTS

CN 101192372 A 6/2008
CN 101281723 A 10/2008
(Continued)

OTHER PUBLICATIONS

Second Chinese Office Action Appln. No. 201410317208.6; dated Mar. 14, 2016.
(Continued)

*Primary Examiner* — Srilakshmi K Kumar
*Assistant Examiner* — Brent D Castiaux
(74) *Attorney, Agent, or Firm* — Ladas & Parry LLP; Loren K. Thompson

(57) ABSTRACT

A pixel circuit and driving method thereof, and a display device can achieve a threshold voltage compensation function, which facilitates reducing the pixel size of AMOLED and achieving high PPI. The pixel circuit comprises a plurality of pixel units arranged in a matrix and each including a sub-pixel unit (b) and a light emitting element (a), the sub-pixel unit (b) including a driving transistor
(Continued)

electrically connected with the light emitting element (a), corresponding to each row of pixel units, the pixel circuit further comprises a row sharing unit (c) electrically connected with each pixel unit of the corresponding row via a first connection line; corresponding to each column of pixel units, the pixel circuit further comprises a column sharing unit (d) electrically connected with each pixel unit of the corresponding column via a second connection line; the sub-pixel unit (b), the row sharing unit (c), and the column sharing unit (d) constitute a circuit having a function of compensating for a threshold voltage of the driving transistor in the sub-pixel unit.

17 Claims, 10 Drawing Sheets

(52) U.S. Cl.
CPC ..... *G09G 2300/043* (2013.01); *G09G 2300/0426* (2013.01); *G09G 2300/0819* (2013.01); *G09G 2310/027* (2013.01); *G09G 2310/0262* (2013.01)

(58) Field of Classification Search
CPC ..... G09G 2310/027; G09G 2300/043; G09G 2300/0426; G09G 2300/0819
See application file for complete search history.

(56) References Cited

U.S. PATENT DOCUMENTS

2007/0115225 A1* 5/2007 Uchino ..... G09G 3/3233 345/76
2007/0124633 A1* 5/2007 Kim ..... G09G 3/2003 714/726
2007/0126667 A1* 6/2007 Nakamura ..... G09G 3/3233 345/76
2008/0238953 A1* 10/2008 Ogura ..... G09G 3/3275 345/697
2008/0259064 A1 10/2008 Chiou
2009/0021455 A1 1/2009 Miller et al.
2009/0256865 A1* 10/2009 Jun ..... G09G 3/3688 345/690
2009/0262258 A1* 10/2009 Taneda ..... G09G 3/3233 348/739
2011/0050741 A1 3/2011 Jeong
2012/0019499 A1 1/2012 Hwang et al.
2014/0049568 A1 2/2014 Qi et al.
2014/0184481 A1* 7/2014 Kim ..... G09G 3/3233 345/82
2014/0192038 A1* 7/2014 Qin ..... G09G 3/3258 345/212
2014/0333214 A1* 11/2014 Okuno ..... G09G 3/32 315/172
2015/0145845 A1* 5/2015 Nam ..... G09G 3/3233 345/209

FOREIGN PATENT DOCUMENTS

CN 101996581 A 3/2011
CN 102005178 A 4/2011
CN 102044213 A 5/2011
CN 102654975 A 9/2012
CN 202512329 U 10/2012
CN 103531151 A 1/2014
CN 103714778 A * 4/2014
TW 200842707 A 11/2008
TW 200842807 A 11/2008

OTHER PUBLICATIONS

First Chinese Office Action Appln. No. 201410317208.6; dated Nov. 4, 2015.
International Search Report Appln. No. PCT/CN2014/088393; dated Mar. 27, 2015.
Written Opinion of the International Searching Authority Appln. No. PCT/CN2014/0876642; dated Mar. 27, 2015.

* cited by examiner

PIXEL CIRCUIT AND DRIVING METHOD THEREOF, AND DISPLAY DEVICE

CROSS REFERENCE TO RELATED APPLICATIONS

This application is a national stage application under 35 U.S.C. 371 and claims the benefit of PCT Application No. PCT/CN2014/088393 having an international filing date of Oct. 11, 2014, which designated the United States, which PCT application claimed the benefit of Chinese Application No. 201410317208.6 filed Jul. 3, 2014, the disclosure of each of which are incorporated herein by reference.

TECHNICAL FIELD OF THE DISCLOSURE

The present disclosure relates to a pixel circuit and driving method thereof, and a display device.

BACKGROUND

Active Matrix Organic Light Emitting Diode (AMOLED) Panels, as display technology applied to televisions and mobile devices, have broad application prospects in portable electronic devices that are sensitive to power consumption due to its characteristics of low power consumption, low cost, and large size. Its core component—Organic Light Emitting Diode (OLED) emits light as driven by the current generated when a Driving Thin Film Field Effect Transistor (TFT) is in a saturated state. However, when a same grayscale voltage is input, different driving currents will be generated due to different critical voltages of the Driving Thin-Film Field Effect Transistor, which will cause inconsistent currents. Furthermore, uniformity in threshold voltages Vth is very poor under the manufacturing process of Low Temperature Poly-silicon (LTPS) technology, and the threshold voltage Vth also drifts.

SUMMARY

In an embodiment of the present disclosure, there is provided a pixel circuit, comprising a plurality of pixel units arranged in a matrix and each including a sub-pixel unit and a light emitting element, the sub-pixel unit including a driving transistor electrically connected with the light emitting element, wherein: corresponding to each row of pixel units, the pixel circuit further comprises a row sharing unit electrically connected with each pixel unit of the corresponding row via a first connection line; corresponding to each column of pixel units, the pixel circuit further comprises a column sharing unit electrically connected with each pixel unit of the corresponding column via a second connection line; the sub-pixel unit of each pixel unit, the row sharing unit corresponding to the pixel unit, and the column sharing unit corresponding to the pixel unit constitute a circuit having a function of compensating for a threshold voltage of the driving transistor in the sub-pixel unit.

Optionally, the sub-pixel unit further includes a second switching element, a third switching element, and a first capacitor, wherein: a gate of the driving transistor is electrically connected with a second terminal of the second switching element, a first terminal of the first capacitor, and a second terminal of the third switching element; a source of the driving transistor and a second terminal of the first capacitor both are electrically connected with a low level voltage line; a drain of the driving transistor is electrically connected with a first terminal of the third switching element and a second terminal of the light emitting element; a first terminal of the second switching element is electrically connected with the second connection line; a control terminal of the third switching element is electrically connected with a first control signal line, and a control terminal of the second switching element is electrically connected with a second control signal line.

Optionally, the row sharing unit includes a fourth switching element, a second terminal of the fourth switching element is electrically connected with a first terminal of the light emitting element in each pixel unit of the corresponding row via the first connection line; a first terminal of the fourth switching element is electrically connected with a high level voltage line, a control terminal of the fourth switching element is electrically connected with a third control signal line.

Optionally, the column sharing unit includes a second capacitor and a fifth switching element, a second terminal of the second capacitor and a second terminal of the fifth switching element both are electrically connected with the first terminal of the second switching element in the sub-pixel unit of each pixel unit of the corresponding column via the second connection line; a first terminal of the second capacitor is electrically connected with a grayscale writing voltage line of the pixel units of the corresponding column; a control terminal of the fifth switching element is electrically connected with an initial control signal line, a first terminal of the fifth switching element is electrically connected with a first voltage signal line.

Optionally, the driving transistor and the switching elements are Field Effect Transistors (FETs), the first terminal of the switching element is a drain of the Field Effect Transistor, the second terminal of the switching element is a source of the Field Effect Transistor, the control terminal of the switching element is a gate of the Field Effect Transistors.

Optionally, the Field Effect Transistors are Thin Film Transistors (TFTs).

Optionally, the light emitting element is an Organic Light Emitting Diode (OLED).

Optionally, the row sharing unit and the column sharing unit are located outside an effective display area of the pixel circuit.

In the embodiment of the present disclosure, there is further provided a display device comprising any one of the pixel circuits as described above.

In the embodiment of the present disclosure, there is further provided a driving method of a pixel circuit, the pixel circuit adopting the pixel circuit as described above, the driving method comprising: an initialization step: in an initialization phase, signals on the first control signal line, the second control signal line, and the initial control signal line are valid concurrently, the second switching element, the third switching element, and the fifth switching element are turned on, a potential at the gate of the driving transistor is set to a voltage on the first voltage signal line; a threshold voltage reading step: in a threshold voltage reading phase, the signals on the first control signal line and the second control signal line are valid concurrently, the second switching element and the third switching element are turned on, the potential at the gate of the driving transistor is discharged via the first capacitor, to compensate for the threshold voltage of the driving transistor; a grayscale writing step: in a grayscale writing phase, the signal on the second control signal line is firstly valid and then changes into invalid, the second switching element is firstly turned on and then turned off, a voltage on the grayscale writing voltage line is written into the gate of the driving transistor; and a light emitting step: in a light emitting phase, the signal on the third control signal line is valid, the potential at the gate of the driving transistor is maintained under the action of the first capacitor, the driving transistor is turned on so as to drive the light emitting element to emit light.

The embodiments of the present disclosure have at least the following beneficial effects:

In the embodiments of the present disclosure, based on original pixel units arranged in a matrix, the circuit that achieves the threshold voltage compensation function is divided into three parts: a row sharing part, a column sharing part, and a pixel self-serving part. Corresponding to each light emitting element, the row where it residues shares a single row sharing unit, the column where it residues shares a single column sharing unit, and it uses a sub-pixel unit by itself. Such configuration simplifies the circuit that achieves the threshold voltage compensation function. Along with the reduction of the adopted elements, element consumption and layout space are saved, which not only reduces the cost, but also facilitates reducing the pixel size of AMOLED and achieving high number of Pixels Per Inch (PPI).

BRIEF DESCRIPTION OF THE DRAWINGS

FIG. 5(*b*) is a circuit structural diagram of a row sharing unit in a pixel circuit in an embodiment of the present disclosure;

FIG. 5(*c*) is a circuit structural diagram of a column sharing unit in a pixel circuit in an embodiment of the present disclosure;

DETAILED DESCRIPTION

Figure 1:
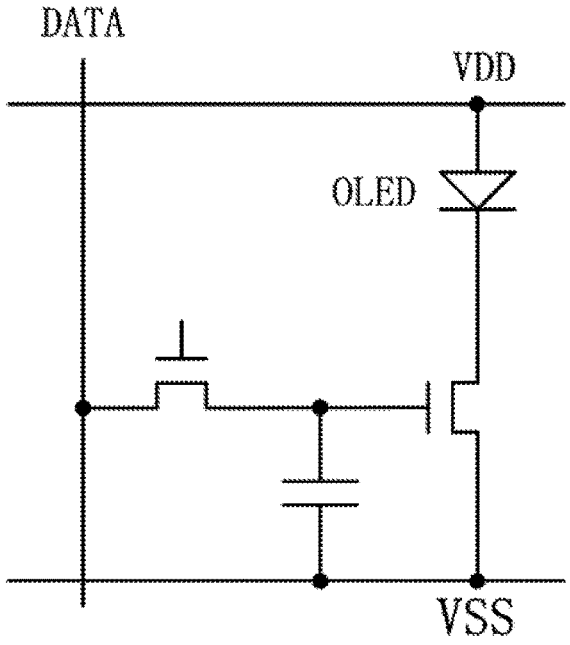
FIG. 1 is a schematic diagram of a conventional basic 2T1C AMOLED pixel unit.

FIG. 1 shows a schematic diagram of a conventional basic 2T1C AMOLED pixel unit. Uniformity in luminance achieved by the conventional 2T1C (2 TFT's and 1 capacitor) circuits shown in FIG. 1 is poor.

In view of this problem, usually a circuit having the function of compensating for the threshold voltage of the driving TFT is added in pixel design of the LTPS-based AMOLED in the prior art. A common design for the AMOLED pixel circuit with the threshold voltage compensation requires 6T2C or more elements. Increase of the number of TFT or capacitor will occupy larger layout space, and go against the reduction of AMOLED pixel size, i.e., it restricts the AMOLED development with high PPI (Pixels Per Inch, number of pixels provided in per inch).

Figure 2:
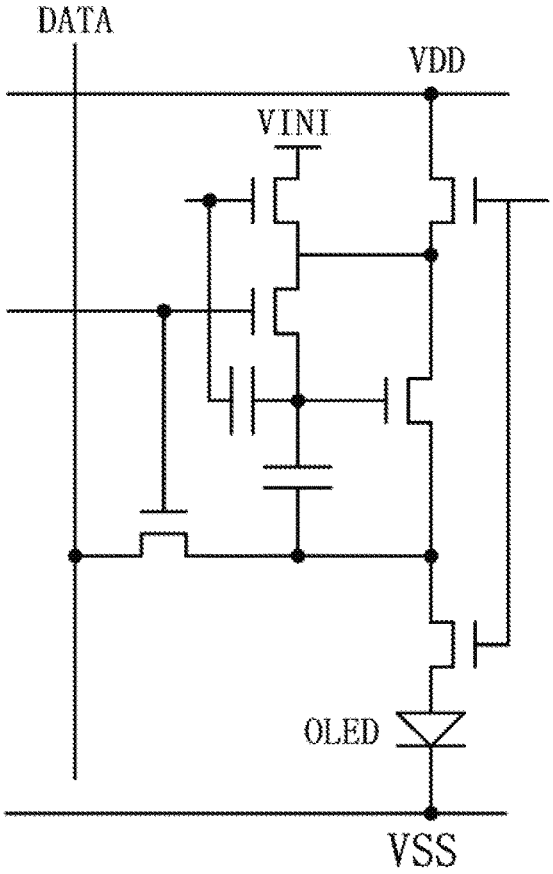
FIG. 2 is a schematic diagram of a 6T2C AMOLED pixel unit with threshold voltage compensation.
Figure 3:
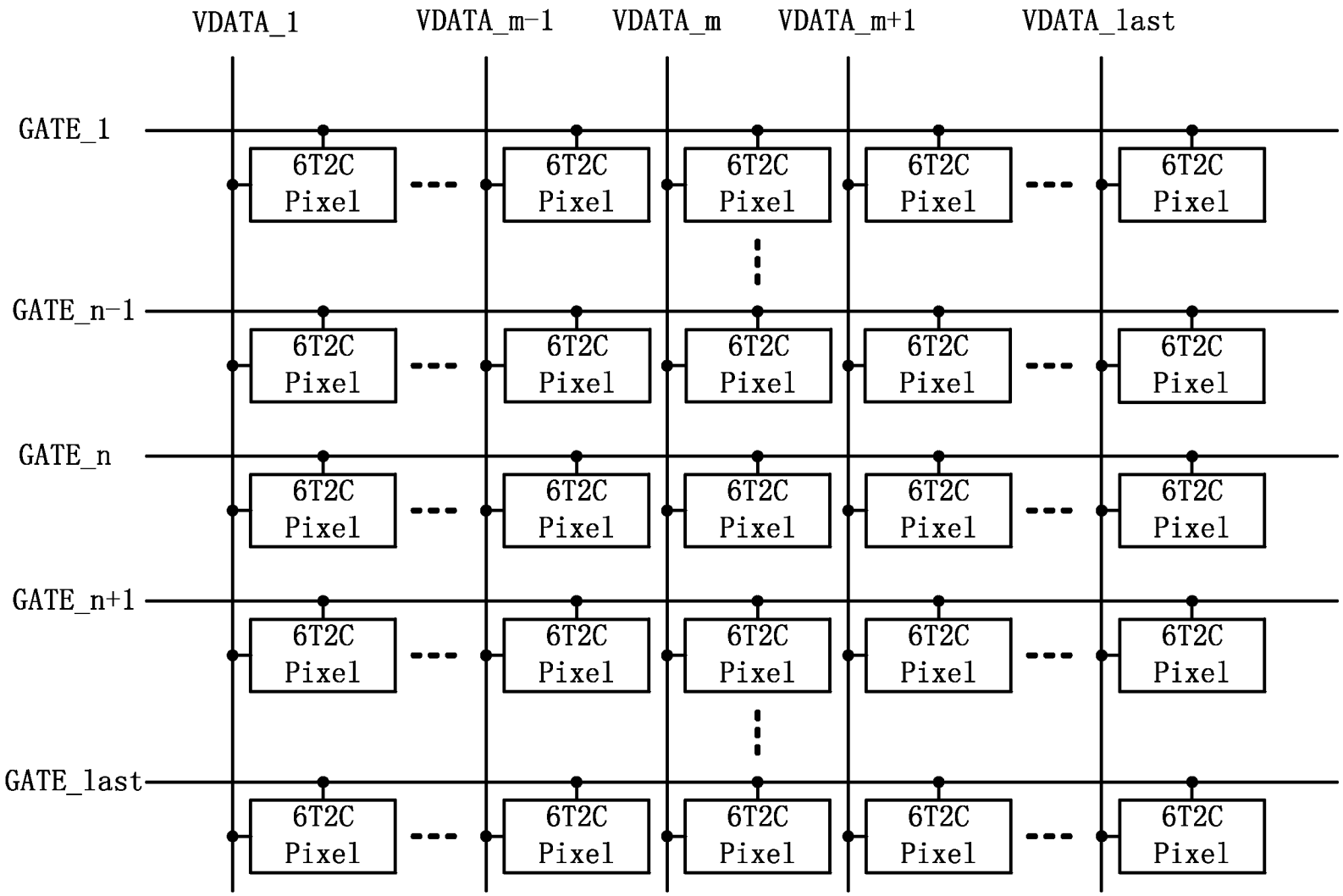
FIG. 3 is a schematic diagram of principles of an AMOLED pixel circuit constituted by 6T2C pixel units.

FIG. 2 shows a schematic diagram of a 6T2C AMOLED pixel unit with threshold voltage compensation. The 6T2C AMOLED pixel circuit (each 6T2C Pixel in FIG. 2 represents one pixel unit) as shown in FIG. 2 has the function of compensating for the threshold voltage of the driving transistor T1, solves the problem of poor uniformity in luminance of OLEDs caused by the poor uniformity of the threshold voltages of the driving transistors under the process of LTPS. But in the AMOLED pixel circuit thus constituted, the threshold voltage compensation switching TFT the grayscale voltage writing switching TFT, and the driving TFT and so on of the pixel all are designed within the pixel, a larger number of TFTs are needed, as shown in FIG. 3 (comprising a pixel unit 6T2C Pixel, gate lines GATE_1, . . . , GATA_n−1, GATA_n, GATA_n+1 to GATE_last and data lines VDATA_1, . . . , VDATA_m−1, VDATA_m, VDATA_m+1 to VDATA_last). Accordingly, it is disadvantageous to a further reduction of the pixel size, which restricts the AMOLED development with high PPI.

Descriptions will be made clearly and thoroughly for the technical solutions in the embodiments of the present disclosure below, taken in conjunction with the accompanying drawings of the embodiments of the present disclosure. Obviously, the described embodiments are only some but not all of the embodiments of the present disclosure. Other embodiments obtained by those skilled in the art based on the described embodiments without paying inventive labor shall belong to the scope sought for protection in the present disclosure.

First of all, reference signs involved in the drawings will be introduced, wherein in FIGS. 1 to 11:

a—light emitting element; b—sub-pixel unit; c—row sharing unit; d—column sharing unit; T1—driving transistor (driving TFT); T2—second switching element (switching TFT); T3—third switching element (initializing TFT); T4—fourth switching element (light emitting control TFT); T5—fifth switching element (initial voltage input TFT); C1—first capacitor (storage capacitor); C2—second capacitor (input coupling capacitor); EM_1, . . . , EM_n, EM_last—third control signal lines of the first, . . . , n-th row and last row; INITIAL—initial control signal line; OLED—light emitting element (organic light emitting diode); GATE_1, . . . , GATE_n−1, GATE_n, GATE_n+1, GATE_last—scan signal lines of the first, . . . , n−1-th, n-th, n+1-th and last row; CN_1_1, . . . , CN_1_*n*, CN_1_*n*+1, CN_1_last—first control signal lines of the first, . . . , n-th, n+1-th and last row; CN_2_1, . . . , CN_2_*n*, CN_2_*n*+1, CN_2_last—second control signal lines in the first, . . . , n-th, n+1-th row and the last row; DATA_IN—grayscale writing voltage line; DATA—gray writing voltage signal (second connection line); VLD—high level voltage line; VSS—low level voltage line; VINI—first voltage signal line; Vdata_1/ . . . /Vdata_m−1/Vdata_m/Vdata_m+1/Vdata_last—grayscale writing voltages (it is the column number that follows "_"); VH—OLED anode voltage (i.e., voltage on the first connection line); $V_P$—gate voltage of T1; GND—ground voltage.

Figure 7:
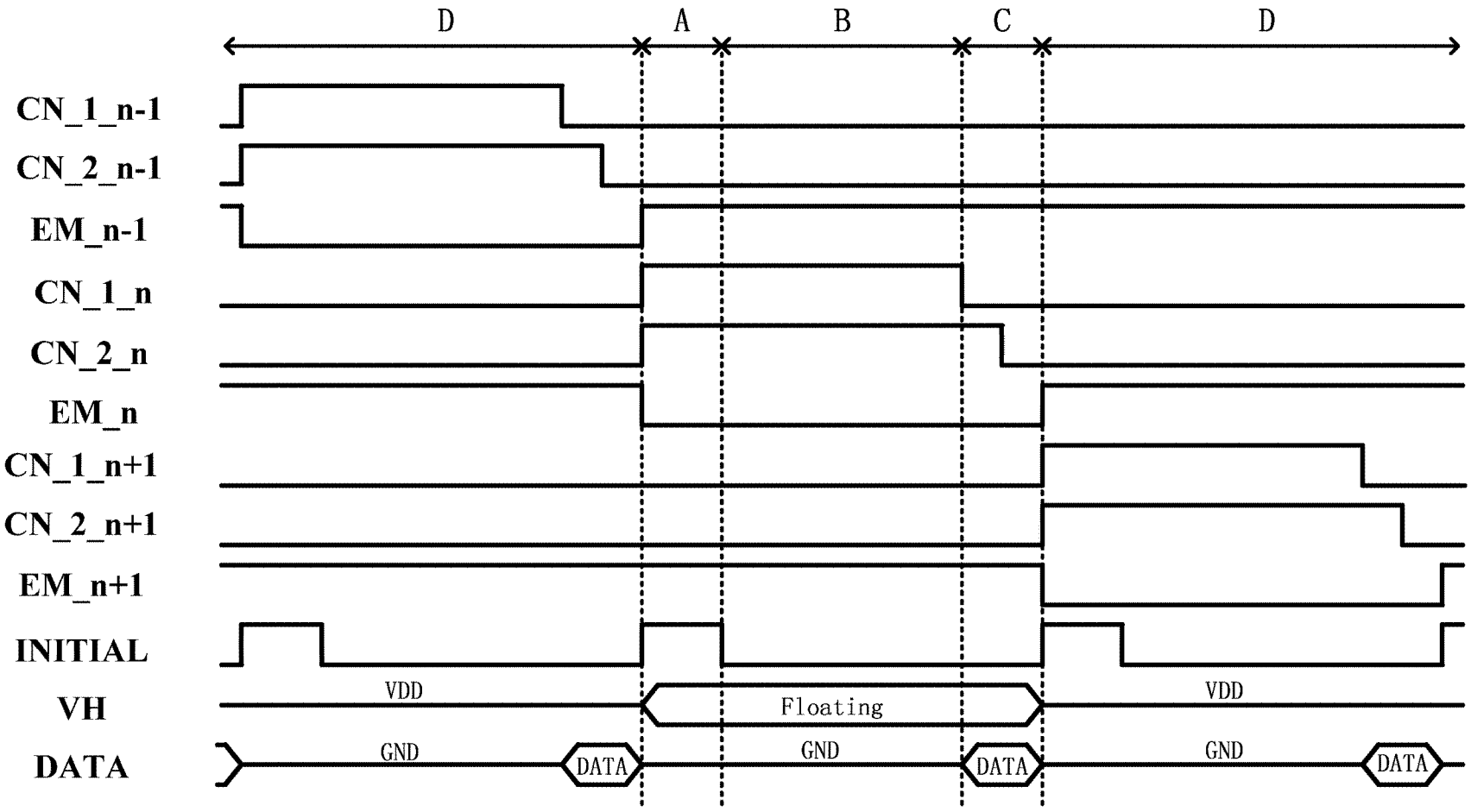
FIG. 7 is a timing sequence diagram of operation of a pixel circuit in an embodiment of the present disclosure.

In addition, in FIG. 7:

A—initialization phase; B—threshold voltage reading phase; C—grayscale writing phase; D—OLED light emitting phase; Floating—floating.

Figure 4:
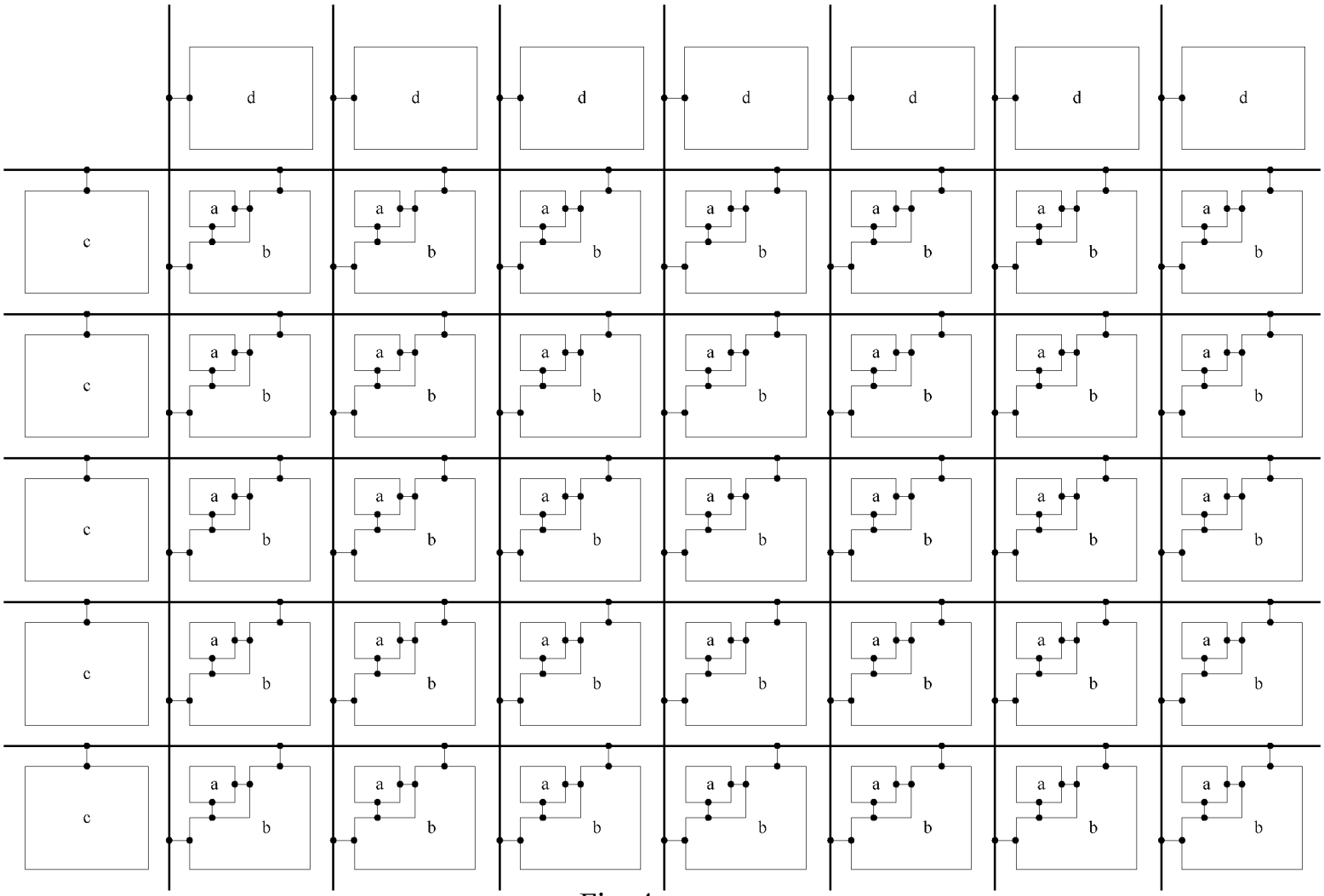
FIG. 4 is a structural block diagram of a pixel circuit in an embodiment of the present disclosure.

In an embodiment of the present disclosure, there is provided a pixel circuit, referring to FIG. 4, the pixel circuit comprises a plurality of pixel units arranged in a matrix and each including a sub-pixel unit b and a light emitting element a, the sub-pixel unit b includes a driving transistor electrically connected with the light emitting element a. Here, corresponding to each row of pixel units, the pixel circuit further comprises a row sharing unit c electrically connected with each pixel unit of the corresponding row via a first connection line; corresponding to each column of pixel units, the pixel circuit further comprises a column sharing unit d electrically connected with each pixel unit of the corresponding column via a second connection line; the sub-pixel unit b of each pixel unit, the row sharing unit c corresponding to the pixel unit, and the column sharing unit d corresponding to the pixel unit constitute a circuit having a function of compensating for a threshold voltage of the driving transistor in the sub-pixel unit b.

In this way, all the row sharing units c constitute a row sharing circuit, all the column sharing units d constitute a column sharing circuit, and the light emitting element a and the sub-pixel unit b constitute an independent pixel unit. Functionally speaking, each sub-pixel unit b is capable of independently achieving the function of driving the light emitting element a to display; the sub-pixel unit b, the row sharing unit c corresponding to the sub-pixel unit b and the column sharing unit d corresponding to the sub-pixel unit b achieve the function of compensating for the threshold voltage of the driving transistor in the sub-pixel unit b together. By adopting such configuration, the circuit part that achieves the function of compensating for the threshold voltage in the same row can share a single row sharing unit c, and the circuit part that achieves the function of compensating for the threshold voltage in the same column can share a single column sharing unit d, thus saving element consumption and layout space.

Figure 5A:
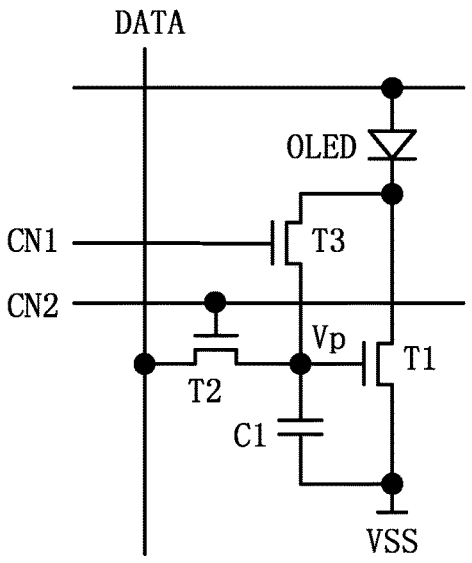
FIG. 5(*a*) is a circuit structural diagram of a pixel unit in a pixel circuit in an embodiment of the present disclosure.
Figure 5B:
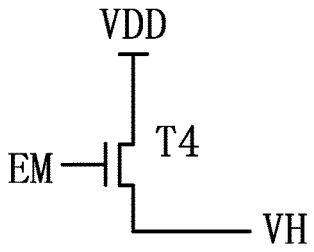
Figure 5C:
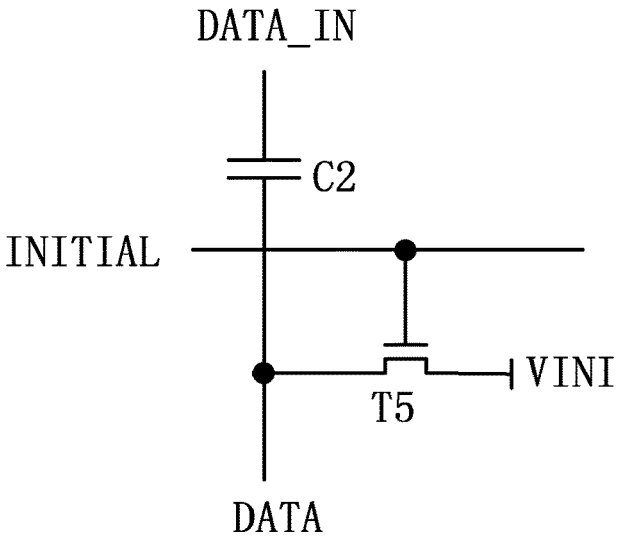

Referring to FIGS. 5(*a*) to 5(*c*), a circuit example of this embodiment will be described below.

The sub-pixel unit b includes a driving transistor T1, a second switching element T2, a third switching element T3, and a first capacitor C1. Here, a gate of the driving transistor T1 is electrically connected with a second terminal of the second switching element T2, a first terminal of the first capacitor C1, and a second terminal of the third switching element T3; a source of the driving transistor T1 and a second terminal of the first capacitor C1 both are electrically connected with a low level voltage line VSS; a drain of the driving transistor T1 is electrically connected with a first terminal of the third switching element T3 and a second terminal of the light emitting element OLED; a first terminal of the second switching element T2 is electrically connected with the second connection line DATA; a control terminal of the third switching element T3 is electrically connected with a first control signal line CN1, and a control terminal of the second switching element T2 is electrically connected with a second control signal line CN2.

The row sharing unit c includes a fourth switching element T4, a second terminal of the fourth switching element 1T4 is electrically connected with a first terminal of the light emitting element a in each pixel unit of the corresponding row via the first connection Line VH; a first terminal of the fourth switching element T4 is electrically connected with a high level voltage line VDD, a control terminal of the fourth switching element T4 is electrically connected with a third control signal line EM.

The column sharing unit D includes a second capacitor C2 and a fifth switching element T5, a second terminal of the second capacitor C2 and a second terminal of the fifth switching element T5 both are electrically connected with the first terminal of the second switching element T2 in the sub-pixel unit b of each pixel unit of the corresponding column via the second connection line DATA; a first terminal of the second capacitor C2 is electrically connected with a grayscale writing voltage line DATA_IN of the pixel unit of the corresponding column; a control terminal of the fifth switching element T5 is electrically connected with an initial control signal line INITIAL, a first terminal of the fifth switching element T5 is electrically connected with a first voltage signal line VINI.

Optionally, the driving transistor T1 and the switching elements are Field Effect Transistors (FETs), the first terminal of the switching element is a drain of the Field Effect Transistor, the second terminal of the switching element is a source of the Field Effect Transistor, and the control terminal of the switching elements is a gate of the Field Effect Transistor.

Optionally, the Field Effect Transistors are Thin Film Transistors (TFTs).

Optionally, the light emitting element is an Organic Light Emitting Diode (OLED), of course, it may also be other current-driven two-terminal light-emitting elements.

Optionally, the row sharing unit c and the column sharing unit d are located outside an effective display area of the pixel circuit. Correspondingly, since the pixel units are located within the effective display area, such design can reduce the number of elements in the effective display area, and facilitate improving PPI.

In addition, based on division of function, the first capacitor is a storage capacitor, and the second capacitor is a coupling capacitor. It should be noted that, labels like "second", "third" and so on used before the switching elements only function as differentiating the corresponding element symbols in circuit diagrams, they do not have particular orders or other meanings per se.

Figure 6:
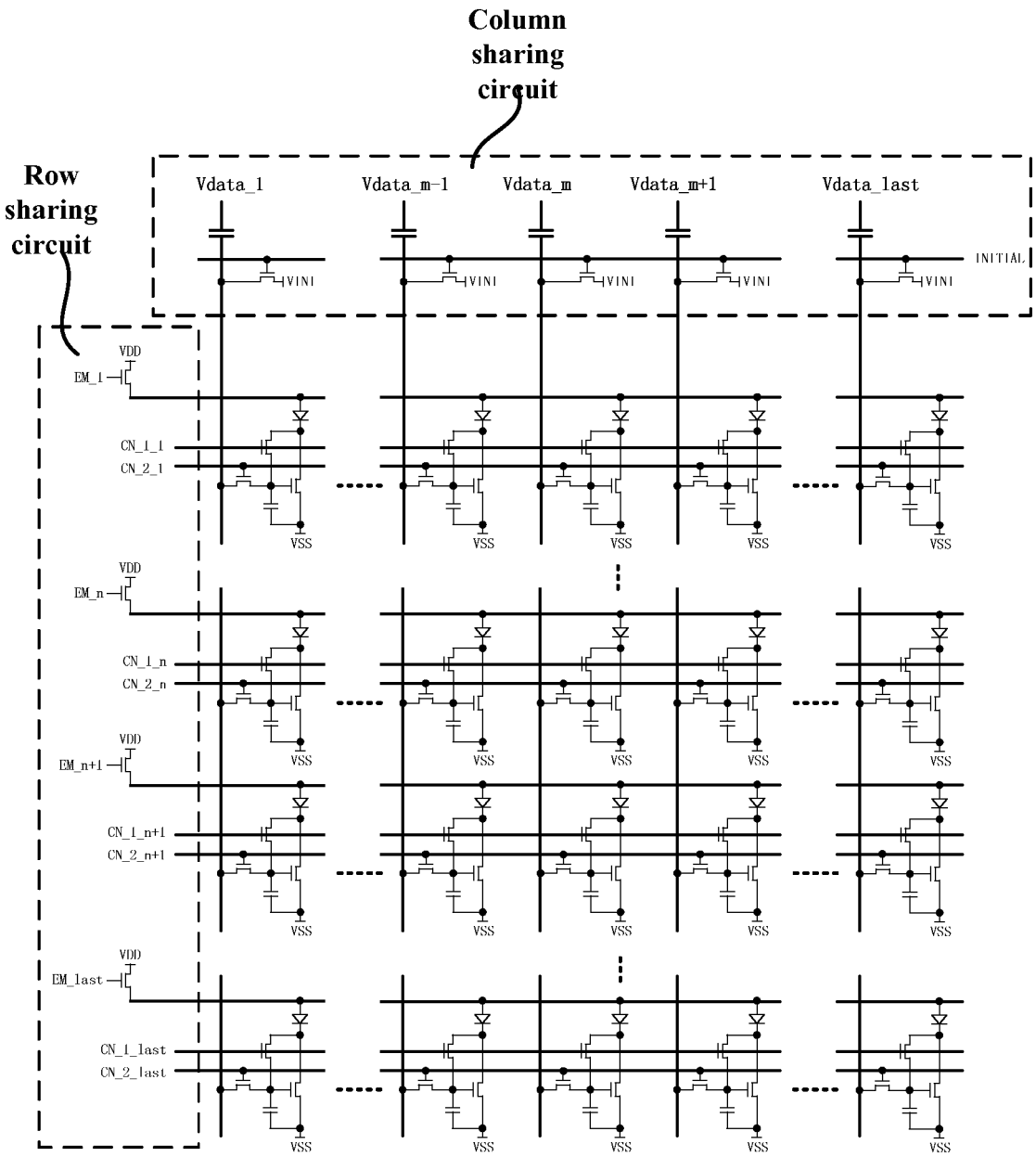
FIG. 6 is a circuit diagram of a pixel circuit in an embodiment of the present disclosure.

The pixel circuit constituted by combining all the above solutions will be presented below, as shown in FIG. 6 (FIG. 6 is a circuit constituted by taking the pixel unit shown in FIG. 5(*a*), the row sharing unit shown in FIG. 5(*b*), and the column sharing unit shown in FIG. 5(*c*) as basic units, and corresponds to the structural block diagram of the pixel circuit as shown in FIG. 4). The pixel circuit comprises a pixel array arranged by at least one row and at least one column of pixel units (3T1C Pixel), row sharing units each for a row (constituting a row sharing circuit) and column sharing units each for a column (constituting a column sharing circuit). The pixel unit includes a driving transistor T1 (driving TFT), a second switching element T2 (switching TFT), a third switching element T3 (initializing TFT), a first capacitor C1 (storage capacitor), and an Organic Light Emitting Diode OLED. A gate of the driving transistor T1 is connected with a source of the second switching element T2 and a source of the third switching element T3, and is connected with a source of the driving transistor T1 via the first capacitor C1; a cathode of the Organic Light Emitting Diode OLED is connected with a drain of the driving transistor T1 and a drain of the third switching element T3.

The row sharing unit c includes a fourth switching element T4 (light emitting control TFT), a source of the fourth switching element T4 is connected with an anode of the Organic Light Emitting Diode OLED in each pixel unit of the corresponding row; the column sharing unit d includes a second capacitor C2 and a fifth switching element T5, a first terminal of the second capacitor C2 and a source of the fifth switching element are connected with a drain of the second switching element T2 in each pixel unit of the corresponding column.

The structural diagram of the circuit including the pixel units (a+b), the row sharing units c, and the column sharing units d can make reference to FIG. 6. It can be seen that, each row of pixels share one row sharing unit, which comprises sharing a single transistor and a single first signal line (i.e., the line connected with the anodes of the OLEDs in FIG. 6); each column of pixels share one column sharing unit, which comprises sharing a single transistor and a single capacitor, and sharing a grayscale writing voltage line (i.e., the line connected with the first terminal of the capacitor in the column sharing unit in FIG. 6). Thereby, the separated row sharing TFT circuit and column sharing TFT circuit can be integrated outside the pixel array, so that the elements adopted by the entire configuration are simplified to a large extent, the required space also is less, which more facilitates reducing the size of AMOLED, achieving high PPI.

Of course, all the switching elements in the above pixel circuit achieve their functions as switches in a digital circuit, other types of transistors may also have corresponding functions, and it is not limited to the one type transistor of TFT. In addition, the capacitors C1 and C2 adopted in the above pixel circuit are a storage capacitor and an input coupling capacitor, respectively, other types of capacitors may have the same functions in proper using environment and parameter setting, so it is not limited to only the type specified here. Accordingly, a pixel circuit using transistors and capacitors of other types but the same functions, all falls into the protection scope claimed by the claims of the present disclosure, once its entire circuit design is also implemented with the row sharing unit c and the column sharing unit d.

The operating manner of the pixel circuit is as follows.

Constant operating high and low levels are applied between the drain of the fourth switching element T4 and the source of the driving transistor T1 (VDD is the high level voltage line, VSS is the low level voltage line), a constant first voltage signal $V_{INI}$ (provided by the first voltage signal line VINI) is applied to the drains of all the fifth switching elements T5.

Referring to FIG. 7, when driving each row of pixel units (e.g. n-th row), the third control signal EM_n fed on the gate of the fourth switching element T4 in the corresponding (n-th row) row sharing unit c changes from a high level into a low level, and passes through the initialization phase (A), the threshold voltage reading phase (B), and the grayscale writing phase (C), whose time are fixed respectively, in turn, and thereafter returns to the high level. The initial control signal $V_{INITIAL}$ (NITIAL in FIG. 7, provided by the initial control signal line INTIAL) fed on the gates of all the fifth switching elements T5 is at the high level only within the initialization phase. The first control signal CN_1_*n* fed on the gates of the third switching elements T3 in all the pixel units of this row is at the high level only within the initialization phase and the threshold voltage reading phase. The second control signal CN_2_*n* fed on the gates of the second switching elements T2 in all the pixel units of this row is at the high level within the initialization phase, the threshold voltage reading phase, and the first half period of the grayscale writing phase. The grayscale writing voltage Vdata_m (DATA in FIG. 7) corresponding to the pixel unit in a corresponding column (e.g., m-th column) in this row (n) is fed on the second terminal of the second capacitor in the corresponding (m-th column) column sharing unit d only within the grayscale writing phase, and it is GND in the other phases.

Accordingly, as for each row of pixel units needing to be driven, they all implement the process of initialization-threshold voltage reading-grayscale writing according to the above method to achieve display driving, thereafter the corresponding OLED emits light under the action of the driving current.

In the above operating manner, the principles of achieving the threshold compensation function are as follows.

Referring to FIG. 7, the driving circuit drives by rows, the driving process for each row is divided into four phases: the initialization phase A, the threshold voltage reading phase B, the grayscale writing phase C, and the OLED emitting light phase D. FIG. 7 is a timing sequence diagram of operation of the pixel circuit, the high level and low level transition of each voltage is already shown therein. VDD and VSS not mentioned therein always provide high level voltage and low level voltage to the pixel circuit.

Figure 8:
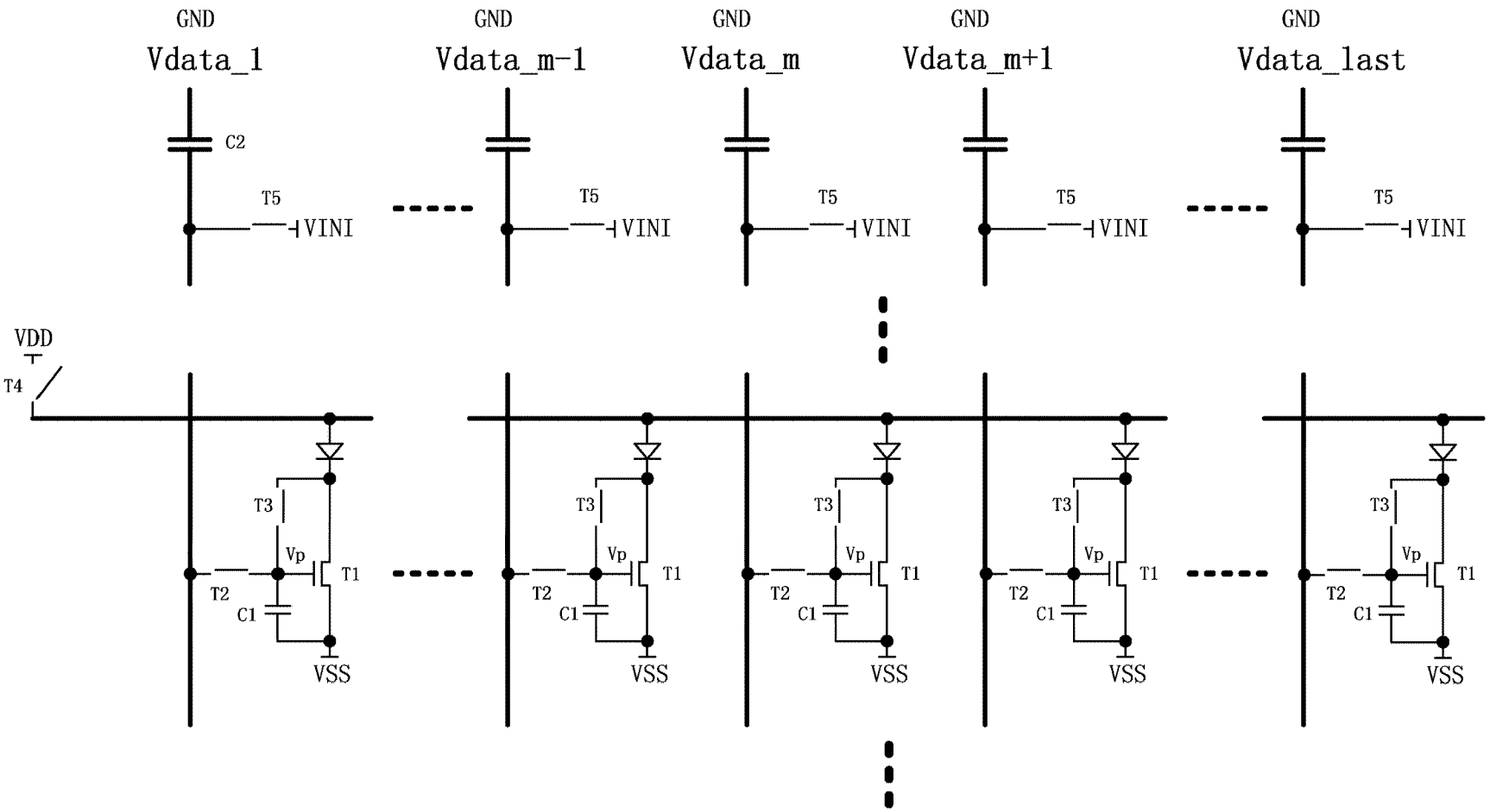
FIG. 8 is a schematic diagram of circuit operational principle in an initialization phase of a driving method in an embodiment of the present disclosure.

In the initialization phase A, EM_n is at a low level, INITIAL, CN_1_*n*, and CN_2_*n* are at a high level, DATA_IN is GND. Referring to FIG. 8, in this case, T2, T3, and T5 are turned on. T4 is turned off, anode voltage $V_H$ of the OLED is Floating (floating, its amplitude is not fixed). The drain and gate of T1 are connected, so that its gate voltage $V_P$ is communicated via T2, T3, and T5, and then has a same potential with $V_{INI}$, i.e. $V_P=V_{IN}$.

Figure 9:
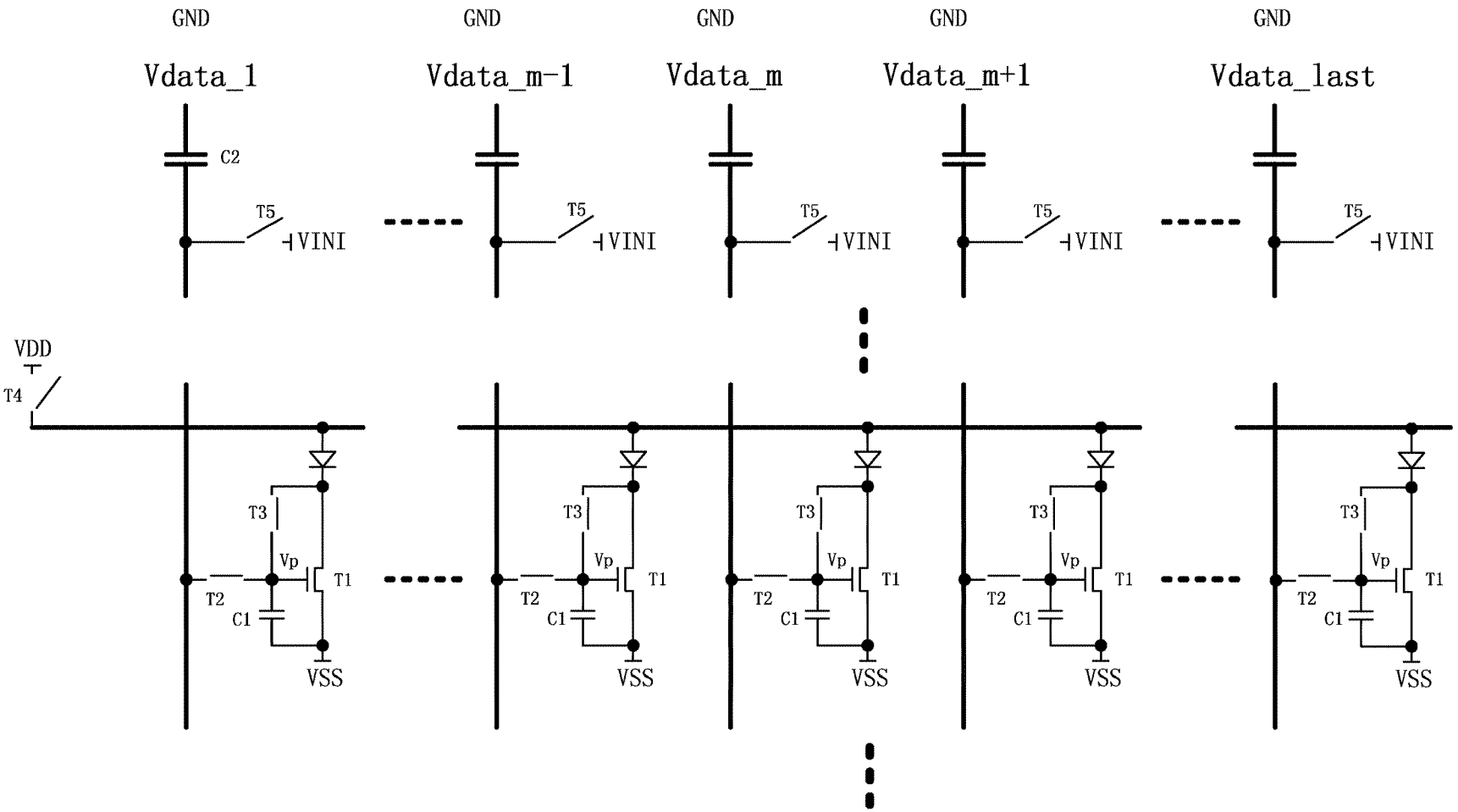
FIG. 9 is a schematic diagram of circuit operational principle in a threshold voltage reading phase of a driving method in an embodiment of the present disclosure.

In the threshold voltage reading phase B, EM_n maintains at a low level, CN_1_*n* and CN_2_*n* maintain at a high level, but INITIAL changes into a low level. Referring to FIG. 9, in this case, T4 maintains OFF, T2 and T3 maintain ON, T5 changes from ON into OFF. The drain and gate of T1 maintain to be connected so as to form a diode connection structure, a point $V_P$ between C1 and C2 will be discharged from the first voltage signal $V_{INI}$ to the threshold voltage $V_{th}$ of T1, i.e., $V_P=V_{th}$. The other terminal of C1 is $V_{SS}$, and the other terminal of C2 is GND (DATA), so that the voltage across C1 is $V_{th}$-$V_{SS}$, a voltage across the entirety of C1 and C2 is 0. After this phase, the threshold voltage $V_{th}$ of T1 is read out, and can be further processed.

Figure 10:
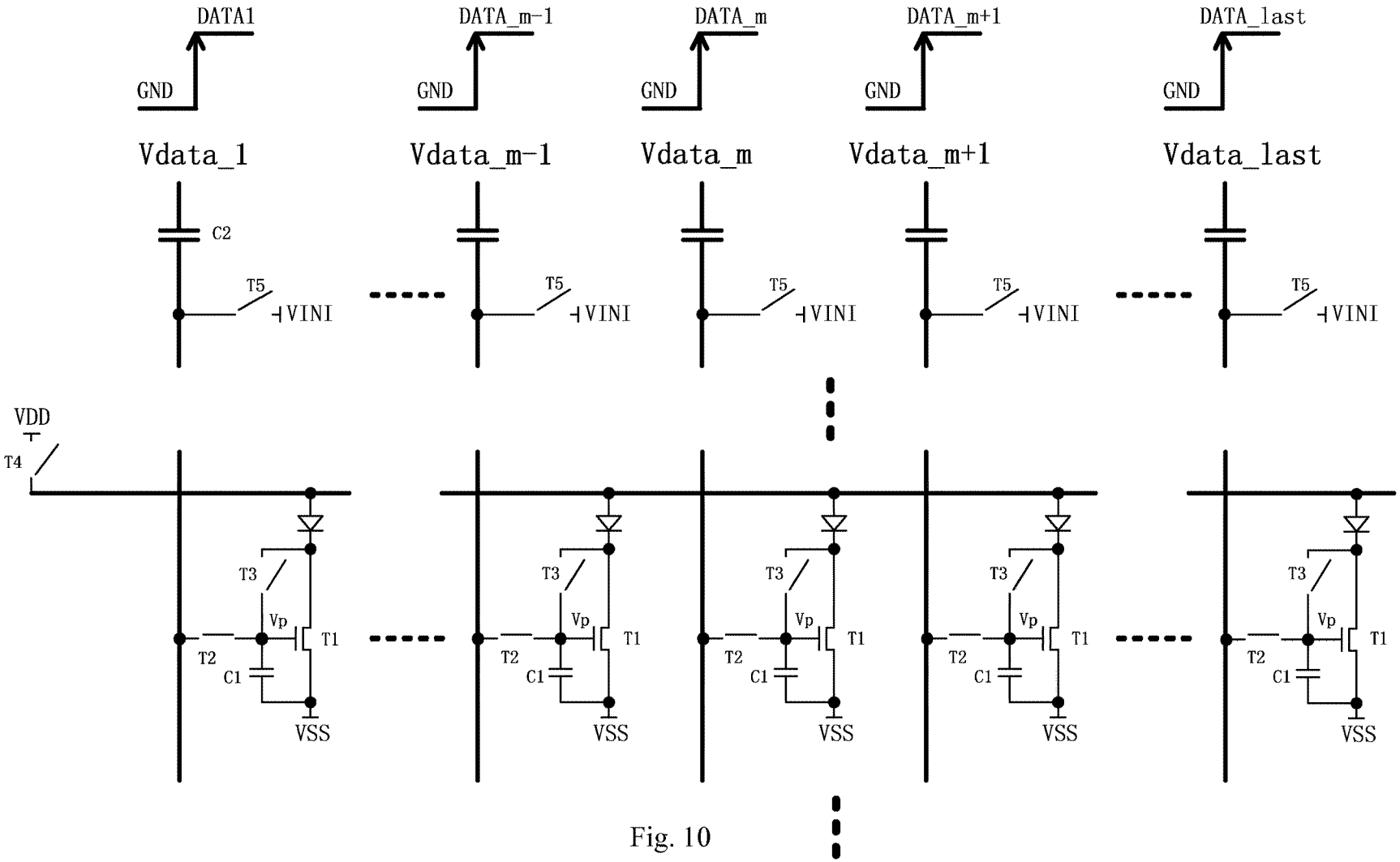
FIG. 10 is a schematic diagram of circuit operational principle in a grayscale writing phase of a driving method in an embodiment of the present disclosure.

In the grayscale writing phase C, EM_n and INITIAL maintain at a low level, CN_1_*n* changes into a low level, and CN_2_*n* is firstly at a high level and then changes into a low level, and DATA_IN changes from GND into a grayscale voltage $V_{DATA}$ (its value corresponds to row n column m). Referring to FIG. 10, under the coupling effect of C2, in the high level phase of CN_2_*n*, $V_P$ jumps from $V_{th}$ into:

$$V_P = \frac{C_2}{C_1 + C_2} \cdot V_{DATA} - V_{SS} + V_{th},$$

where C1 and C2 are capacitance values of C1 and C2, since one terminal of C1 is connected with one terminal of C2, voltage at the other terminal of C2 varies, which will affect the voltage of the terminal where C1 and C2 are connected according to formulas of capacitive coupling. The voltage at the terminal where C1 and C2 are connected changes into a voltage obtained by multiplying $V_{DATA}$ by C2/(C1+C2). Then CN_2_*n* changes into a low level, T2 is tuned off, at the gate of T1, i.e., the point where $V_P$ resides, is maintained by the storage capacitor C1 as:

$$V_P = \frac{C_2}{C_1 + C_2} \cdot V_{DATA} - V_{SS} + V_{th}.$$

Figure 11:
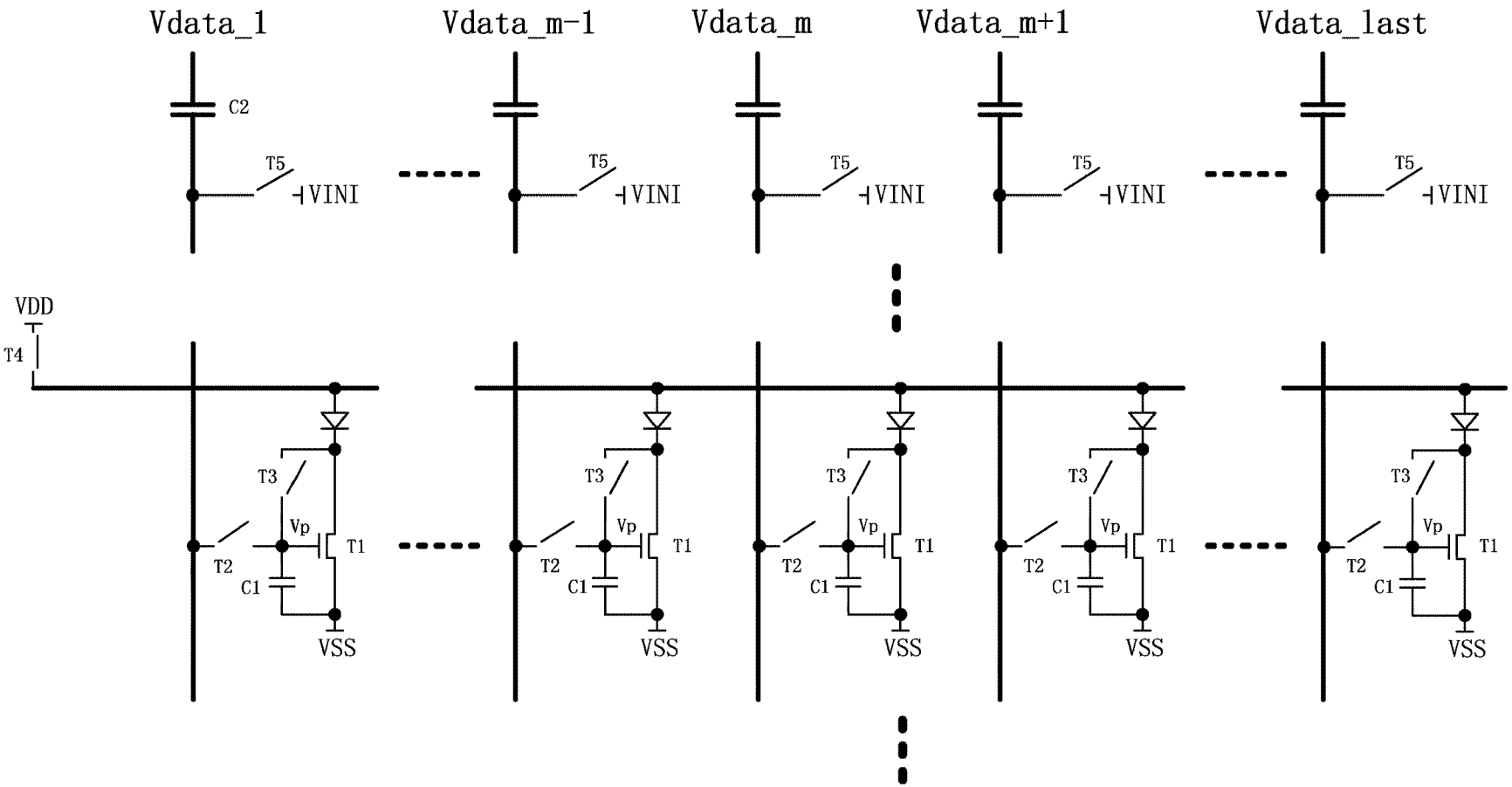
FIG. 11 is a schematic diagram of circuit operational principle when an OLED emits light normally in a driving method in an embodiment of the present disclosure.

In the OLED light emitting phase D, EM_n changes into a high level, CN_1_*n* and CN_2_*n* are at a low level. Referring to FIG. 11, in this case, T2 and T3 are turned off, T4 is turned on, the anode voltage $V_H$ of OLED changes from Floating into $V_{DD}$. $V_P$ maintains to be $$V_P = \frac{C_2}{C_1 + C_2} \cdot V_{DATA} + V_{th}$$

under the effect of the storage capacitor C1, i.e., T1 drives the OLED with the source-drain current $I_{DS}$:

$$\begin{aligned} I_{DS} &= \frac{\mu C_{ox}}{2} \cdot \frac{W}{L} \cdot \left( \frac{C_2}{C_1 + C_2} \cdot V_{DATA} - V_{SS} + V_{th} - V_{th} \right)^2 \\ &= \frac{\mu C_{ox}}{2} \cdot \frac{W}{L} \cdot \left( \frac{C_2}{C_1 + C_2} \cdot V_{DATA} - V_{SS} \right)^2. \end{aligned}$$

It can be seen that, finally, the driving current of OLED is independent of the threshold voltage $V_{th}$ of T1, that is, the threshold voltage compensation function which the conventional 2T1C (FIG. 1) pixel unit does not possess is achieved.

Further, each pixel unit of the driving circuit only adopts three transistors and one capacitor, the number of elements in each pixel unit is reduced significantly compared with the 6T2C pixel unit (FIGS. 2 to 3), only a row of column sharing units d and a column of row sharing units c are disposed outside the effective display area, element consumption and layout space are saved, which not only reduces the cost, but also facilitates reducing the pixel size of AMOLED and achieving high PPI.

In an embodiment of the present disclosure, based on the same inventive concept, there is further provided a display device, the display device comprises any one of the above-described pixel circuits, and it carries out display driving through any one of the above-described driving methods. The display device may be any products or components having a display function such as e-paper, OLED panel, mobile phone, tablet computer, television, monitor, notebook computer, digital picture frame, navigation system, and so on. Since the display device has the same technical features as any one of the above-described pixel circuits, it therefore solves the same technical problem and achieves the same technical effect.

In conformity with the content of the operating manner of the pixel circuit described above, a method for driving the above pixel circuit is provided herein, the driving method comprises: an initialization step: in an initialization phase A, signals on the first control signal line, the second control signal line, and the initial control signal line are valid concurrently, the second switching element, the third switching element, and the fifth switching element are turned on, a potential at the gate of the driving transistor is set to a voltage on the first voltage signal line; a threshold voltage reading step: in a threshold voltage reading phase B, the signals on the first control signal line and the second control signal line are valid concurrently, the second switching element and the third switching element are turned on, the potential at the gate of the driving transistor is discharged via the first capacitor, to compensate for the threshold voltage of the driving transistor; a grayscale writing step: in a grayscale writing phase C, the signal on the second control signal line is firstly valid and then changes into invalid, the second switching element is firstly turned on and then turned off, a voltage on the grayscale writing voltage line is written into the gate of the driving transistor; and a light emitting step: in a light emitting phase D, the signal on the third control signal line is valid, the potential at the gate of the driving transistor is maintained under the action of the first capacitor, the driving transistor is turned on so as to drive the light emitting element to emit light.

In summary, the present disclosure achieves the threshold voltage compensation function with the 3T1C pixel circuits by adopting the manner of parts of TFTs being shared, which facilitates reducing the pixel size of AMOLED and achieving high PPI.

It should be noted that, in this description, relational terms such as first and second and the like are merely used to distinguish one entity or operation from another entity or operation, without necessarily requiring or implying these entities or operations have such actual relationship or sequence therein between.

The above embodiments are merely to describe, not intended to limit, the technical solutions of the present disclosure; although the present disclosure have already been described in detail with reference to the above embodiments, as will be appreciated by those of ordinary skill in the art, it is still possible to modify the technical solutions recorded in the above respective embodiments, or make equivalent alternatives to partial technical features contained therein; and these modifications or alternatives do not make corresponding technical solutions depart from the spirit and scope of the technical solutions in the respective embodiments of the present disclosure.

The present application claims priority of Chinese Patent Application No. 201410317208.6 filed on Jul. 3, 2014, the entire content of which is hereby incorporated by reference as part of the present disclosure.

What is claimed is:

1. A pixel circuit, comprising a plurality of pixel units arranged in a matrix and each including a sub-pixel unit and a light emitting element, the sub-pixel unit including a driving transistor electrically connected with the light emitting element, wherein:

corresponding to each row of pixel units, the pixel circuit further comprises a row sharing unit electrically connected with each pixel unit of the corresponding row via a first connection line;

corresponding to each column of pixel units, the pixel circuit further comprises a column sharing unit, the column sharing unit has an input terminal connected to a grayscale writing voltage line of the corresponding column of pixel units, and an output terminal connected to a second connection line of the corresponding column of pixel units, the second connection line is connected to each of pixel units of the corresponding column and supplies a compensated grayscale writing voltage to each of pixel units of the corresponding column to compensate for a threshold voltage of the driving transistor in the sub-pixel unit;

the sub-pixel unit of each pixel unit, the row sharing unit corresponding to the pixel unit, and the column sharing unit corresponding to the pixel unit constitute a circuit having a function of compensating for the threshold voltage of the driving transistor in the sub-pixel unit;

the column sharing unit includes a second capacitor and a fifth switching element, wherein a second terminal of the second capacitor and a second terminal of the fifth switching element are both electrically connected with the second connection line, a first terminal of the second capacitor is electrically connected with the grayscale writing voltage line of the pixel units of the corresponding column, a control terminal of the fifth switching element is electrically connected with an initial control signal line, a first terminal of the fifth switching element is electrically connected with a first voltage signal line.

2. The pixel circuit of claim 1, wherein the sub-pixel unit further includes a second switching element, a third switching element, and a first capacitor, wherein:

a gate of the driving transistor is electrically connected with a second terminal of the second switching element, a first terminal of the first capacitor, and a second terminal of the third switching element;

a source of the driving transistor and a second terminal of the first capacitor both are electrically connected with a low level voltage line;

a drain of the driving transistor is electrically connected with a first terminal of the third switching element and a second terminal of the light emitting element;

a first terminal of the second switching element is electrically connected with the second connection line;

a control terminal of the third switching element is electrically connected with a first control signal line, and a control terminal of the second switching element is electrically connected with a second control signal line.

3. The pixel circuit of claim 1, wherein the row sharing unit includes a fourth switching element, a second terminal of the fourth switching element is electrically connected with a first terminal of the light emitting element in each pixel unit of the corresponding row via the first connection line;

a first terminal of the fourth switching element is electrically connected with a high level voltage line, a control terminal of the fourth switching element is electrically connected with a third control signal line.

4. The pixel circuit of claim 2, wherein the second terminal of the second capacitor and the second terminal of the fifth switching element both are electrically connected with the first terminal of the second switching element in the sub-pixel unit of each pixel unit of the corresponding column via the second connection line.

5. The pixel circuit of claim 4, wherein the driving transistor and the switching elements are Field Effect Transistors, the first terminal of the switching element is a drain of the Field Effect Transistor, the second terminal of the switching element is a source of the Field Effect Transistor, the control terminal of the switching element is a gate of the Field Effect Transistor.

6. The pixel circuit of claim 5, wherein the Field Effect Transistors are Thin Film Transistors.

7. The pixel circuit of claim 1, wherein the light emitting element is an Organic Light Emitting Diode.

8. The pixel circuit of claim 1, wherein the row sharing unit and the column sharing unit are located outside an effective display area of the pixel circuit.

9. A display device comprising the pixel circuit of claim 1.

10. A driving method of a pixel circuit, the pixel circuit adopting the pixel circuit of claim 4, the driving method comprising:

an initialization step: in an initialization phase, signals on the first control signal line, the second control signal, and the initial control signal line are valid concurrently, the second switching element, the third switching element, and the fifth switching element are turned on, a potential at the gate of the driving transistor is set to a voltage on the first voltage signal line;

a threshold voltage reading step: in a threshold voltage reading phase, the signals on the first control signal line and the second control signal line are valid concurrently, the second switching element and the third switching element are turned on, the potential at the gate of the driving transistor is discharged via the first capacitor, to compensate for the threshold voltage of the driving transistor;

a grayscale writing step: in a grayscale writing phase, the signal on the second control signal line is firstly valid and then changes into invalid, the second switching element is firstly turned on and then turned off, a voltage on the grayscale writing voltage line is written into the gate of the driving transistor; and a light emitting step: in a light emitting phase, the signal on the third control signal line is valid, the potential at the gate of the driving transistor is maintained under the action of the first capacitor, the driving transistor is turned on so as to drive the light emitting element to emit light.

11. The display device of claim 9, wherein the sub-pixel unit further includes a second switching element, a third switching element, and a first capacitor, wherein:

a gate of the driving transistor is electrically connected with a second terminal of the second switching element, a first terminal of the first capacitor, and a second terminal of the third switching element;

a source of the driving transistor and a second terminal of the first capacitor both are electrically connected with a low level voltage line;

a drain of the driving transistor is electrically connected with a first terminal of the third switching element and a second terminal of the light emitting element;

a first terminal of the second switching element is electrically connected with the second connection line;

a control terminal of the third switching element is electrically connected with a first control signal line, and a control terminal of the second switching element is electrically connected with a second control signal line.

12. The display device of claim 9, wherein the row sharing unit includes a fourth switching element, a second terminal of the fourth switching element is electrically connected with a first terminal of the light emitting element in each pixel unit of the corresponding row via the first connection line;

a first terminal of the fourth switching element is electrically connected with a high level voltage line, a control terminal of the fourth switching element is electrically connected with a third control signal line.

13. The display device of claim 11, wherein the column sharing unit includes a second capacitor and a fifth switching element, a second terminal of the second capacitor and a second terminal of the fifth switching element both are electrically connected with the first terminal of the second switching element in the sub-pixel unit of each pixel unit of the corresponding column via the second connection line;

a first terminal of the second capacitor is electrically connected with a grayscale writing voltage line of the pixel units of the corresponding column; a control terminal of the fifth switching element is electrically connected with an initial control signal line, a first terminal of the fifth switching element is electrically connected with a first voltage signal line.

14. The display device of claim 13, wherein the driving transistor and the switching elements are Field Effect Transistors, the first terminal of the switching element is a drain of the Field Effect Transistor, the second terminal of the switching element is a source of the Field Effect Transistor, the control terminal of the switching element is a gate of the Field Effect Transistor.

15. The display device of claim 14, wherein the Field Effect Transistors are Thin Film Transistors.

16. The display device of claim 9, wherein the light emitting element is an Organic Light Emitting Diode.

17. The display device of claim 9, wherein the row sharing unit and the column sharing unit are located outside an effective display area of the pixel circuit.

* * * * *